United States Patent [19]

McCormick

[11] 4,024,617

[45] May 24, 1977

[54] METHOD OF APPLYING A REFRACTORY COATING TO METAL SUBSTRATE

[75] Inventor: Harold E. McCormick, Ballwin, Mo.

[73] Assignee: Ramsey Corporation, St. Louis, Mo.

[22] Filed: Mar. 6, 1973

[21] Appl. No.: 338,457

[52] U.S. Cl. ..... 29/156.63; 29/156.6; 219/10.43; 219/10.49; 219/10.53; 228/194; 427/34; 427/46; 427/374 A; 427/383 D

[51] Int. Cl.[2] ..... B23P 15/06

[58] Field of Search ..... 29/498, 473.1, 156.6, 29/156.63; 427/34, 46, 191, 372, 374, 383; 228/194; 277/235 R, 235 A, 224, 96; 219/10.41, 10.43, 10.49, 10.53, 10.75

[56] References Cited

UNITED STATES PATENTS

| | | | |
|---|---|---|---|
| 1,998,496 | 4/1935 | Fiedler | 427/46 X |
| 2,297,878 | 10/1942 | Deneen et al. | 219/10.41 X |
| 2,400,472 | 5/1946 | Strickland, Jr. | 219/10.75 X |
| 2,803,559 | 8/1957 | Rutherford et al. | 219/10.53 UX |
| 3,145,466 | 8/1964 | Feduska | 29/498 X |
| 3,170,234 | 2/1965 | Torr | 29/498 X |
| 3,197,858 | 8/1965 | Feduska et al. | 29/498 X |
| 3,431,615 | 3/1969 | Hogodorn et al. | 29/498 X |
| 3,436,806 | 4/1969 | Supan | 29/498 X |
| 3,444,613 | 5/1969 | Foerster | 29/473.1 |
| 3,539,192 | 11/1970 | Prasse et al. | 277/224 |
| 3,680,197 | 8/1972 | Blum et al. | 29/498 X |
| 3,690,686 | 9/1972 | Prasse et al. | 277/235 A |
| 3,697,091 | 10/1972 | Prasse et al. | 277/235 A |

OTHER PUBLICATIONS

*Ferrous Metals and Alloys*, vol. 74, 1971, No. 78918c, "Plasma Spray Production of Wear-and Corrosion-resistant...", 427–434.

*Primary Examiner*—Ronald J. Shore

[57] ABSTRACT

A method of applying a refractory coating or facing to a ferrous metal substrate that is in the form of a finished article, such as that of a piston seal or the like, and that has sections of such small dimensions as to be easily distorted by heat. The method includes an induction heating step carried out under conditions so controlled as to effect a bond of greatly improved strength in shear between the coating and substrate without, however, causing heat distortion of even the small dimensioned sections beyond functionally permissible limits. An agent capable of effecting diffusion bonding, such as free nickel, or an alloy or mixtures containing free nickel or an equivalent bonding element, is made available at the interface in the coating and substrate to facilitate the obtaining of such greatly improved bond as a result of the induction heating step. The bond obtained is in excess of 10,000 psi in shear and generally equal to or in excess of the tensile strength of the refractory coating.

30 Claims, 3 Drawing Figures

METHOD OF APPLYING A REFRACTORY COATING TO METAL SUBSTRATE

BACKGROUND OF THE INVENTION

This invention has for its background methods for applying refractory coatings or facings to sealing elements, such as piston rings, packing rings and other seals for use in restricting or preventing the flow of fluids between superficially contacting, relatively slidable surfaces.

Prior art disclosing suitable refractory coatings and methods for applying the same to piston rings includes U.S. Nos. 2,905,512; 3,133,739; 3,133,341; 3,281,156; 3,539,192; 3,606,359; 3,690,686 and 3,697,091.

SUMMARY OF THE INVENTION

The present invention provides a method of applying coatings to formed ferrous metal substrates to effect a bond therebetween of greatly improved strength in shear, and frequently of a strength equal to or greater than the tensile strength of the coating.

Heretofore, in spite of improved hard, wear- and scuff-resistant coatings such as those disclosed in some of the above-referred to patents, bond failures between the substrates and the coatings or facings therefor occur after extended periods of service in isolated instances, particularly in high B.M.E.P. engines. For engines with brake mean effective pressure ratings in excess of 190 psi the bond strength between coating and substrate should be at least 10,000 psi as measured by a coating bond shear test.

Although it is highly desirable that the bond strength in shear should be at least equal to the tensile strength of the coating, some recent piston seal facings have higher cohesive strength than adhesive strength.

An object of this invention therefore is to provide a method for improving the bond strength between the piston seal substrate and its hard, wear- and scuff-resistant coating or facing material.

It is a further object of this invention to provide a seal facing in which the bond strength of the coating material relative to the substrate is approximately equal to or even greater than the tensile strength of the facing material.

It is another object of this invention to provide a facing or coating for a piston seal which has a bond strength in shear relative to the base seal material of more than 10,000 psi.

It is still another object of this invention to provide a method of applying a piston seal facing in which certain elements or constituents of the facing diffuse readily into the seal substrate to form a diffusion bond.

It is still another object of this invention to provide a method for diffusion bonding the face coating of the piston seal to the base metal without distorting the piston seal beyond functional limits for adequate sealing.

It is yet another object of this invention to provide a low-cost method of diffusion bonding the face coating to the base metal in short time cycles of induction heating.

Diffusion bonding in itself is not new in the art. However, up until now, it has been feasible or practicable to diffusion-bond piston seal facings because of the requirement that high temperatures be used over long periods of time to effect the diffusion of elements of the facing into the substrate.

Piston seals are generally of relatively small cross section and are required to be manufactured to exacting precision to effect the required sealing. The distortion caused by extended exposure to high temperatures, e.g. of about 1700°F. and higher, has been so great as to render the resulting seals non-functionable.

A requirement for effective diffusion bonding is that the coating itself, or the basis seal material, or both, contain elements which will diffuse into the mating surfaces at the interface at temperatures above those of the plastic state but less than those of the molten state of the basis seal material.

Since piston seals are usually made from a ferrous metal or alloy, e.g. a cast iron, or so called "piston iron", it is desirable that the facing material, usually an alloy, itself have a constituent which will diffuse into cast iron. One such constituent which diffuses quickly into cast iron upon the application of heat is nickel.

A second method is to utilize an intermediate coating between the facing material and the substrate which will diffuse into both the substrate and the face coating and effect the desired bonding.

Prior investigators have shown that high pressures and temperatures are necessary to effect a diffusion bond and that exacting surface preparation is necessary and that probably the process must be conducted in a controlled atmosphere. Prior investigations also show that diffusion bonding may be effected through cycling the article or articles to be diffusion bonded through cycling the article or articles to be diffusion bonded through a temperature range above and below a phase transformation point but well below the melting point of the materials involved.

Since piston seals are characterized by being of relatively small cross section and since the hard facing as applied is only in the order of 0.012 thick and since the seals themselves must not deform in the process, it is important that the bulk temperatures of the seals not exceed about 500° F. The phase transformation point for nickel and most metallic materials is much higher -- in the order of 1600° – 2000° F.

An object of the induction heating employed in this 15 to restrict the cycle heating and cooling to a depth equivalent to the thickness of the coating plus only several thousandths of an inch into the substrate, thereby obtaining localized heating at the bond line while bulk temperatures are kept below 500°F., and in this manner reducing any tendency of the piston seal to be distorted by the heating and cooling steps employed.

Other objects, features and advantages of the invention will be readily apparent from the following description of certain preferred embodiments thereof, taken in conjunction with the accompanying drawings, of which variations and modifications may be effected without departing from the spirit and scope of the novel concepts of the disclosure, and in which the following detailed description of the annexed sheet of drawings by way of preferred example illustrates several embodiments of the invention.

DESCRIPTION OF THE PREFERRED EMBODIMENT

Figure 1:
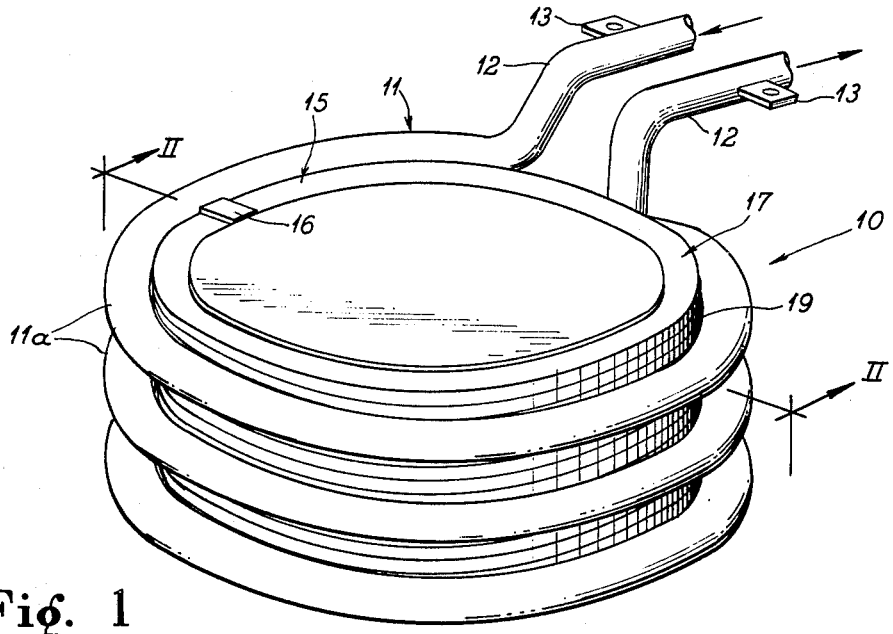
FIG. 1 is a perspective view of induction heating coils for use in practicing the method of my invention.

The reference numeral 10 indicates generally apparatus suitable for providing induction heating in carrying out the method of my invention. The apparatus 10 includes a coil 11 formed of a plurality of turns 11a of electrically conductive metal tubing 12, 12 having connectors 13, 13 for applying a suitable alternating electric current to the coil 11. Sources of high frequency induction heating equipment are well known and the operation of such equipment for induction heating is commonplace. Consequently, no detailed description of the apparatus 10 or of its principles of operation need be given here.

Piston seals are indicated by the reference numeral 15. The piston seals may be conventional piston rings such as used in internal combustion engines of the reciprocating piston type, or may be seals such as are used in rotary type internal combustion engines for sealing the rotor and the inner trochoid surface of the rotor housing. In either the reciprocating type or the rotary type of internal combustion engine the function of the seal is to prevent or restrict the flow of fluids, including combustion gases, between the superficially contacting, relatively slidable surfaces of the piston and its housing.

Since a piston ring as initially formed is provided with a gap it is necessary, before applying induction heating, to close the gap with a connector, such as illustrated at 16, to complete the electrical circuit through each individual ring 15. A plurality of such piston rings, or seals, can conveniently be arranged in a stack, indicated generally by the reference numeral 17, or the seals can be individually processed. In order to maintain a relatively low bulk temperature in the rings 15, or stack 17 of rings, provision is made for circulating a coolant, indicated at 18, through the tubes of the induction coil 11. Preferably, a stack of rings 17 is positioned in contact with or in close proximity to the inner surfaces 19 of the turns 11a of the heating coil 11. The coolant circulated through the coil 11 is preferably water, but any fluid or liquid that is not appreciably heated by electrical induction can be used.

Figure 2:
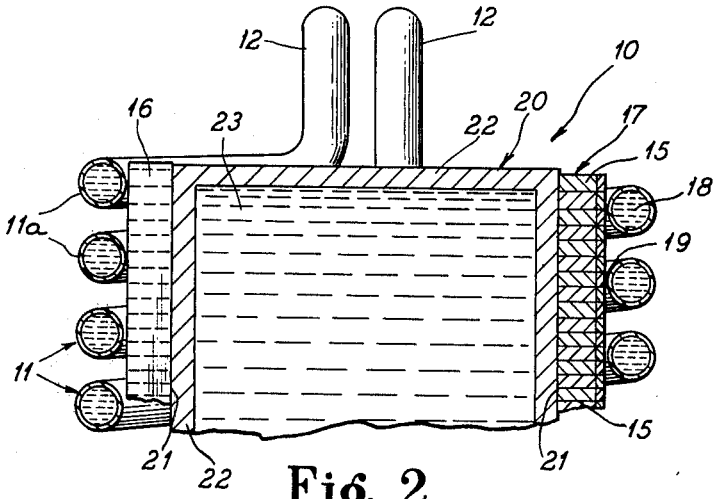
FIG. 2 is a sectional view taken substantially along the line II—II of FIG. 1, with parts broken away.

Optionally, as illustrated in FIG. 2, the stack 17 of piston seals can be so arranged with respect to cooling means 20 as to effect a cooling of the ring inner surfaces 21. Said cooling means 20 includes a coolant confining wall 22 containing a suitable cooling liquid 23, which may be water. As pointed out earlier herein, the coolant should not be one that becomes heated by inductance or hysteresis to any great extent. Preferably, there is close contact between the opposed surfaces of the cooling wall 22 and the inner surface 21 of the stacked piston rings 15.

Figure 3:
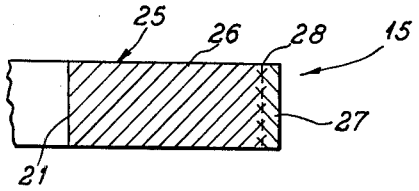
FIG. 3 is an enlarged fragmentary sectional view of a piston seal illustrating the applied coating diffusion bonded to the substrate of the seal.

FIG. 3 illustrates a coated piston ring 25 having a metal substrate 26 and a coating 27 diffusion bonded, as at 28, to the outer periphery of the substrate 26. The substrate 26 is a cast iron, usually a nodular gray cast iron such as customarily used in forming conventional piston rings. The coating 27 that is diffusion bonded to the outer periphery of the basis material of the ring 26 is preferably a hard, wear- and scuff-resistant material such as one of the materials named in one of the prior art patents mentioned earlier herein, that has been modified to include, if not already containing, a constituent or element readily capable of diffusing into the ferrous metal substrate.

DETAILED DESCRIPTION

Prior to initiating my method for the production of piston seals having a diffusion-bonded outer coating or facing of the desired hard, wear- and scuff-resistant properties, the basis material forming the substrate of the piston seal has been processed in any conventional manner for the reception of the coating or facing material. The surface to be coated is preferably grit-blasted and the coating selected is then applied to the surface so prepared. The coating may be applied by means of a plasma jet flame, an electric arc, or an oxy-acetylene flame, but in accordance with the principles of my invention, a thermal bonding agent, or constituent, is included in the coating or facing material, unless it already contains such an agent, or is otherwise made available at the interface between the ferrous metal substrate and the applied coating or facing. However it may be accomplished, my method makes available at the interface between the coating and the ferrous metal substrate an agent or element that is characterized by being rapidly plasticized at moderate temperatures of around 1600° to 2000°F. One such plasticizing agent is nickel; others are copper, aluminum and compositions or alloys containing any of these metals in a free, and therefore available, state.

Following the thermal application of the coating material to the selected surface, or ground to finished dimensions. Owing to the fact that the remaining steps of my method can be, and are carried out without substantial distortion, the grinding step that is performed at this stage renders unnecessary any subsequent grinding step to meet the required dimensions of the finished piston seal.

Following the grinding of the coated seals to finished dimensions, the seals are placed either singly or in multiples on a fixture, such as the cooled walls 22 of the device 20, as briefly described above. The cooled walls 22 are, as explained previously, in such contact or close proximity with the surfaces of the piston rings or seals 15 as to keep them cool and thereby avoid distortion thereof. The walls 22 are constructed of nonmagnetic materials, such as copper, aluminum, and the like, which have good heat conductivity properties but are not affected by the inductance of the induction coil 11.

Proper pre-determined power settings are applied to the induction coil for very short periods of time, and the power is pulsed on and off for a predetermined number of cycles to effect localized heating and cooling at the interface between the coating 27 and the substrate 26, as at 28 (FIG. 3). The heating of the interface 28 includes a temperature range within which the plasticizing element or constituent, such as nickel, becomes sufficiently plastic to effect diffusion bonding at said interface, as shown by the overlapping cross-hatching at said interface 28.

The coated piston seals are then further cooled to room temperature, or thereabouts, for ease of handling, and are finally processed in the same manner as are conventional piston seals.

As already alluded to, instead of including the diffusing element or consitituent as an integral part of the principal coating or the wear facing, the diffusing element or constituent can be separately applied as an intermediate coating, layer or facing as by electroplating, or by plasma spray or electric arc techniques.

The intermediate coating just referred to may be nickel, itself; or a nickel-containing alloy or compound in which the nickel is available for diffusion bonding, e.g. a nickel-nickel aluminide mixture; a nickel-chromium alloy; a nickel-chromium-boron-silicon brazing alloy, electroless nickel; or other materials that adhere readily to the materials of the substrate and of the refractory coating and that can be readily plasticized by the application of heat. It is significant to note at this point that no external pressures are applied or need be applied to effect the diffusion bond herein described. Neither are any special atmospheres, either inert or non-oxidizing, required for carrying out the inductive heating steps of my method; but where the main diffusing element or constituent is an easily oxidized metal, such as aluminum, it is preferable to carry out any high temperature heating step in a non-oxidizing or even a slightly reducing atmosphere. Improved bonds are accomplished through the short-term cycling induction heating steps described herein.

The following examples will serve to illustrate the method of my invention but it will be understood that they are by way of illustration and not intended to be limiting in their effect.

EXAMPLE I

In this example, a coating, such as the coating 27 (FIG. 3), was plasma jet applied to a shaped substrate 26 as a powder mixture of tungsten carbide, cobalt, nickel, chromium, boron and aluminum, such as described in U.S. Pat. No. 3,539,192, using an undercoating of a nickel-chromium alloy having nickel available for effecting diffusionbonding of the coating composition to the substrate. A preferred nickel-chromium alloy is one derived from a starting mixture of alloy particles comprising 80% by weight nickel and 20% by weight aluminum-coated chromium particles, the nickel-chromium particles comprising 93–95% by weight of the total starting mixture and the balance, 7–5% by weight, being the aluminum coat over the chromium particles.

Thereafter, an improved, stronger bond of the coating to the basis substrate was obtained by subjecting the preliminarily coated piston seals to inductive heating, employing a heating phase of 0.5 seconds and a cooling phase of 0.5 seconds for a total of 20 cycles.

EXAMPLE II

In carrying out this example, a shaped cast iron substrate having the form and dimensions of a finished piston seal was coated with an intermediate coating of a nickel-chromium alloy, as in Example I, and a further or outer coating of a plasma jet applied high strength alloy resulting from a powder mixture of from 65 to 90% molybdenum, 7 to 25% nickel, 1 to 6% chromium, 0.3 to 1.5% boron and 0.2 to 1.5% silicon, all by weight, any balance being from the group consisting of iron, cobalt, carbon and manganese, as disclosed in U.S. Pat. No. 3,690,686. The resulting assembly of the cast iron substrate, intermediate coating of the nickel-chromium alloy, and outer coating as just described, was subjected to the above described induction heat cycling method with a water-cooled fixture such as that indicated by the reference numeral 20 (FIG. 2) serving as a water-cooled heat sink. Improved bonds of the intermediate and final coating to the base metal of the substrate were achieved with a cycle of 0.6 seconds of induction heat and 0.9 seconds of cooling, making a single cycle of 1.5 seconds and carrying through 20 complete cycles in a total time period for the diffusion bonding operation of 30 seconds.

A convenient test for measuring bond strength is to mount a test ring in a twisting fixture and twist the seal until the coating fractures or separates from the substrate. In this test, prior art rings were found to have a failure point 60°, while piston rings processed according to the procedures outlined hereinabove were found to have a failure point of 180° without failure, the 180° being the limit of the fixture capability.

In prior art rings using the plasma-applied coating of U.S. Pat. No. 3,690,686 the bond failure point was 90° without ay auxiliary diffusion bond such as that of this invention, but with the diffusion bonding operation included as in Example II above, the resulting piston ring again withstood a 180° twist without bond failure.

In another test of bond integrity, piston seals were alternately heated to 665° F. in 15 minutes and rapidly quenched in cold water for 5 minutes. A measure of bond integrity is the number of identical cycles a piston seal will withstand prior to separation of the facing. In the piston seals of the prior art, failure occurs in approximately 35 cycles, according to test I have made, whereas when the seals are provided with facings that have been cyclically diffusion-bonded, as per the teachings herein of the present invention, such seals withstand 200 cycles without failure.

EXAMPLE III

In this example, a cast iron substrate having the form and dimensions of a semi-finished piston seal was coated with an intermediate coating of a nickel-chrome alloy. A preferred nickel-chrome alloy is one derived from a starting mixture consisting of alloy particles containing approximately 80% by weight nickel and approximately 20% by weight chrome coated with 5 to 7% by weight aluminum. The ni-chrome alloy comprises about 93–95% by weight of the total particle. Material of this composition is marketed under the trade name METCO 443. This material was applied by the plasma-arc process to a thickness of .001 – .0015. The application parameters to apply the under layer using a single gun Metco 3 MP system were as follows:

| | |
|---|---|
| Nitrogen flow | 90 SCFH |
| Hydrogen flow | 17 SCFH |
| DC current | 350 amps |
| Gun-to-work-distance | 4" to 4½" |
| Powder feed rate | 11 lbs./hr. |
| Carrier gas flow ($N_2$) | 37 SCFH |
| Gun traverse rate | 60 in./min. |
| Work rotation rate | 75 RPM |
| Nozzle | Metco "G" |
| Powder feed wheel | S |
| Powder port | No. 2 |

Following application of the intermediate ni-chrome coating, as above, an outer wear-resistant ceramic coating consisting of 12 to 15% titanium-dioxide and 78% minimum aluminum-oxide by weight was applied using a Metco 3MP system with application parameters as follows:

| | |
|---|---|
| Nitrogen flow | 75 SCFH |
| Hydrogen flow | 15 SCFH |

-continued

| | |
|---|---|
| Carrier gas flow ($N_2$) | 37 SCFH |
| Gun-to-work-distance | 4½ inches |
| DC current | 500 amps |
| Gun traverse rate | 28 in./min. |
| Work rotation rate | 75 RPM |
| Powder feed wheel | Metco S |
| Powder feed rate | 11 lbs./hr. |
| Nozzle | Metco "G" |
| Powder port | No. 2 |

Part of these seals were then heated cyclically according to the teachings of this invention in a Lepel 35 kilowatt dual frequency induction generator, using the following parameters:

| | |
|---|---|
| Frequency | 360 kilocycles |
| Tap KC | 16th |
| Power level setting | 55% |
| Heating cycle | 0.5 sec. on<br>0.7 sec. off<br>for 20 cycles |

The piston seals were then examined for bond strength by the twist method and compared with seals prepared identically except that the induction heating and cooling were omitted. The average bond failure point of the seals which were diffusion bonded as per the procedure outlined was 154. This compares with 125° for those parts which were prepared identically except that the cyclic heating and cooling were omitted. The results were based on seven test of each seal.

EXAMPLE IV

In yet another example, several groups of piston seals were prepared utilizing two oxygen acetylene-fueled, Metco type 2K metal spray guns. On one group of seals, molybdenum was applied directly to the cast iron substrate without an intermediate nickel-chrome diffusion coating. A second group was prepared using a nickel-chromium alloy layer intermediate, the molybdenum outer layer, and the cast iron substrate.

Each group was divided into two portions (a) and (b), one portion being heated and cooled cyclicly in accordance herewith, and the other portion not being so treated. Each portion that was heated and cooled cyclically utilized a Lepel 35 KW dual frequency induction generator and the following parameters:

| | |
|---|---|
| Frequency | 360 kilocycles |
| Tap KC | 16th |
| Power level setting | 45% |
| Heating cycle | 0.6 sec. on<br>0.9 sec. off<br>for 20 cycles |

A fourth group was prepared using an intermediate coating of nickel-chromium alloy and was not subjected to the cyclic heating and cooling to produce diffusion.

The parameters for application of the molybdenum were as follows:

| | |
|---|---|
| Number of Metco 2K guns | 2 |
| Gun-to-work-distance | 3¼" – 3½" |
| Wire protrusion from gun | Maximum ½" |
| Wire feed rate | 10 in./min. |
| Gun angle | 45° |
| Oxygen flow | 88 SCFH |
| Acetylene flow | 30 SCFH |

-continued

| | |
|---|---|
| Air flow | 27 SCFH |

Each group was tested for bond strength using the comparative twist method, and the results were as follows:

| | |
|---|---|
| 1. | Molybdenum applied directly without nickel-chrome intermediate layer and with cyclic heating and cooling 117° |
| 2. | Molybdenum applied over a nickel-chrome alloy intermediate layer and without cyclic heating to produce diffusion 153° |
| 3. | Molybdenum applied directly and cyclically |

This last example number 4 indicates that molybdenum of itself does not diffuse into the iron substrate and that with the more porous molybdenum applied by the oxy-acetylene process the intermediate nickel-chrome alloy coating probably diffuses into the moly coating at the temperatures of the oxy-acetylene moly application process.

The above examples indicate the following:

1. Piston seal facings containing a diffusing material as part of the facing material may be diffusion bonded to the substrate by cyclic heating directly without the need for an intermediate "diffusion" material.

2. Piston seal facings containing a diffusing material may have their bonds improved by the use of an intermediate layer which may be diffused into the facing and the substrate (Examples no. I and no. II).

3. Piston seal facings which do not contain a diffusing material such as nickel or ni-chrome may be diffusion bonded to the substrate by utilizing an intermediate layer containing a material which may be diffused into the piston seal facing material as well as into the substrate by the cyclic application of heat (Example no. III).

4. Piston seal facings having a high degree of porosity and low tensile strength such as oxy-acetylene applied molybdenum may not be diffusion bonded directly without an intermediate layer of nickel or chrome. However, the more porous coatings may bond directly by diffusion at the temperatures of the flame application process if an intermediate layer of high-strength material such as ni-chrome is used (Example no. IV).

I claim:

1. The method of obtaining an improved bond strength in shear at the interface between (1) a formed ferrous metal substrate having sections thereof of such small dimensions as to be readily heat deformable and (2) a refractory coating on said substrate, said method comprising the following steps;

making available to said interface a constituent capable of diffusion bonding the interface surfaces at temperatures within a range above the plastic state temperatures but below the molten state temperatures of said substrate, and cyclicly applying inductive heating and cooling to said surfaces but substantially only to a depth equivalent to the thickness of said coating plus only several thousandths of an inch into said substrate to effect a temperature at said surfaces within the aforesaid range for a sufficient length of time to effect such diffusion bonding without substantial distortion of any of said sections of said formed ferrous metal substrate.

2. The method as defined by claim 1, wherein said ferrous metal substrate is in the form of a piston seal.

3. The method as defined by claim 2, wherein said piston seal is a seal for a rotary piston of a rotary type internal combustion engine.

4. The method as defined by claim 1, wherein said constituent capable of diffusion is nickel or contains nickel in a free state available for diffusion into said substrate and coating.

5. The method as defined by claim 4, wherein said substrate is a cast iron.

6. The method as defined by claim 5, wherein said nickel diffuses into both said substrate and said coating.

7. The method as defined by claim 1, wherein the constituent capable of diffusion is in said refractory coating in an available state for diffusion into said substrate.

8. The method as defined by claim 7, wherein said constituent is selected from the group consisting of nickel, copper, aluminum, and mixtures thereof.

9. The method as defined by claim 1, wherein said refractory coating includes a high strength molybdenum alloy formed in situ on said ferrous metal substrate.

10. The method as defined by claim 9, wherein said alloy is formed by plasma jet application of a mixture of the following ingredients in the specified percentages by weight:

65 to 90% molybdenum
7 to 25% nickel
1 to 6% chromium
0.3 to 1.5% boron 0.2 to 1.5% silicon any balance being from the group consisting of iron, cobalt, carbon and manganese.

11. The method as defined by claim 1, wherein prior to the inductive heating step, said refractory coating containing said constituent is applied to said substrate under thermal conditions such as to cause said coating to adhere thereto, and said coated substrate is then ground to finished dimension.

12. The method as defined by claim 1, wherein prior to the inductive heating step, said constituent is subjected to sufficiently high temperatures to become plastic and cause said coating to bond to said substrate at said interface, and said coated substrate is cooled and ground to finished dimensions.

13. The method as defined by claim 12, wherein said constituent is nickel and is subjected to a plasticizing temperature of about 1600°to 200° F. to cause said coating to bond.

14. The method as defined by claim 13, wherein said inductive heating step is carried out in a predetermined number of short cycles to effect localized heating and cooling at said interface.

15. The method as defined by claim 1, wherein said constituent is made available directly to said substrate prior to applying said coating thereto.

16. The method as defined by claim 15, wherein said constituent includes as the bonding agent free nickel and said refractory coating contains no functionally effective amount of a bonding agent.

17. The method as defined by claim 16, wherein said bonding agent is a nickel-chromium mixture.

18. The method as defined by claim 11, wherein said ferrous metal substrate is a cast iron in the form of a piston seal.

19. The method as defined by claim 1, wherein said steps are carried out without the application of superatmospheric pressure at said interface.

20. The method as defined by claim 1, wherein said refractory coating is a coating resulting from the fusion of a powder containing a mixture of titania and alumina, and the resulting bond strength in shear is at least 10,000 psi.

21. The method as defined by claim 1, wherein said refractory coating contains molybdenum and said constituent comprises nickel in an available state for diffusion bonding.

22. The method as defined by claim 1, wherein said substrate is cooled by subjecting parts thereof remote from said interface to heat exchange with a coolant medium.

23. The method of claim 22, wherein said heat exchange is indirect heat exchange with a coolant contained within a coolant confining wall.

24. The method of claim 22, wherein said coolant is water.

25. The method of obtaining an improved bond strength in shear at the interface between (1) a formed ferrous metal substrate having sections thereof of such small dimensions as to be readily heat deformable and (2) a refractory coating on said substrate, said method comprising the following steps:

making available to said interface a constituent capable of diffusion bonding the interface surfaces at temperatures within a range above the plastic state temperatures but below the molten state temperatures of said substrate, and cyclicly applying inductive heating and cooling to said surfaces but substantially only to a depth equivalent to the thickness of said coating plus only several thousandths of an inch into said substrate to effect by said inductive heating a temperature at said surfaces in order of 1600 – 2000° F for a sufficient length of time to effect such diffusion bonding but at bulk temperatures of said substrate not exceeding about 500° F and without substantial distortion of any of said sections of said formed ferrous metal substrate.

26. The method as defined by claim 25, wherein said coating is only in the order of 0.012 thick.

27. The method as defined by claim 25, wherein said cyclic heating and cooling is accomplished in about 0.5 seconds for each of the heating and cooling phases respectively for a total of about 20 cycles.

28. The method as defined by claim 25, wherein said inductive heating is carried out with a cycle of 0.6 seconds of heating and 0.9 seconds of cooling to make a single cycle of 1.5 seconds, for a total of about 20 cycles over a diffusion bonding operation of about 30 seconds.

29. The method of obtaining an improved bond strength in shear at the interface between (1) a shaped metal substrate of such small sectional dimensions as to be readily deformable by heat and (2) a hard tungsten-boron alloy refractory coating on said substrate, said method comprising the following steps:

applying to a surface at the interface between said substrate and said coating an intermediate coating containing an available diffusion bonding constituent, and inductively heating said coatings to a temperature sufficiently high to effect a diffusion bonding at said interface without substantial distortion of said shaped metal substrate and to hereby obtain a bond strength in shear of at least 10,000 psi.

30. The method as defined by claim 29, wherein said tungsten-boron alloy is a tungsten carbide.

* * * * *